US006484355B2

(12) United States Patent
Cho et al.

(10) Patent No.: US 6,484,355 B2
(45) Date of Patent: Nov. 26, 2002

(54) PASSAGE SYSTEM OF VACUUM CLEANER

(75) Inventors: Seong Ho Cho, Seoul (KR); Seong Bin Lee, Kyounggi-do (KR); Sung IL Park, Kyounggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/933,949

(22) Filed: Aug. 22, 2001

(65) Prior Publication Data

US 2002/0038491 A1 Apr. 4, 2002

(30) Foreign Application Priority Data

Oct. 4, 2000 (KR) ..... 00-58080
Oct. 4, 2001 (KR) ..... 00-58079

(51) Int. Cl.[7] ..... A47L 5/18
(52) U.S. Cl. ..... 15/346; 15/409; 15/344

(58) Field of Search ..... 15/344, 409, 346

(56) References Cited

U.S. PATENT DOCUMENTS 2,746,078 A * 5/1956 Spurlin ..... 15/344
3,206,787 A * 9/1965 Daniels et al. ..... 15/320
3,562,846 A * 2/1971 Creamer et al. ..... 15/328
3,704,482 A * 12/1972 Brannon ..... 15/348
4,023,233 A * 5/1977 Prestwich ..... 15/320

* cited by examiner

*Primary Examiner*—Chris K. Moore
(74) *Attorney, Agent, or Firm*—Birch, Stewart, Kolasch & Birch, LLP

(57) ABSTRACT

A vacuum cleaner containing an air passage system which is modified to increase the amount and speed of air drawn into the vacuum cleaner without increasing the capacity of the motor, whereby the performance of the vacuum cleaner is enhanced.

9 Claims, 3 Drawing Sheets

PASSAGE SYSTEM OF VACUUM CLEANER

BACKGROUND OF THE INVENTION

1. Field of the Invention

The present invention relates to a vacuum cleaner, and more particularly, to a passage system of a vacuum cleaner in which an air passage system is modified to increase an amount and speed of air drawn into a vacuum cleaner without having to increase a capacity of a motor so that the performance of a vacuum cleaner is enhanced.

2. Description of the Related Art

Conventional vacuum cleaners are classified, depending upon a use and a shape, into a cylindrical vacuum cleaner which is generally employed at home, a pot-type vacuum cleaner, which is generally known as a canister vacuum cleaner, for a large places such as a place of business that requires a large capacity, and a portable vacuum cleaner which is easily carried around and employed for a specified purpose (such as a vehicle).

Among various kinds of vacuum cleaners, in case of a rechargeable vacuum cleaner such as the portable vacuum cleaner equipped with a rechargeable battery, it is difficult to produce an output of a sufficient level when using the vacuum cleaner due to the limitation of a capacity of a battery.

FIG. 1 is a schematic cross-sectional view illustrating a construction of a passage system of the conventional vacuum cleaner.

Referring to FIG. 1, the passage system of the conventional vacuum cleaner comprises a suction motor 10 which is installed on an upper end of the vacuum cleaner to provide a suction force for sucking the outside air into the vacuum cleaner, a suction fan 20 which is placed below the suction motor 10 and blades for sucking the outside air using rotating force of the suction motor 10, a dust filter 30 which is placed below the suction fan 20 to filter dust contained in the outside air sucked by the suction fan 20, a dust-collecting bucket 40 which is positioned below the dust filter 30 to collect dust and the like filtered by the dust filter 30, and a suction nozzle 50 which is arranged below the dust collecting bucket 40 to elevate the speed of flow of the outside air sucked from the outside by the suction fan 20, up to a predetermined value.

Operations of the passage system of the conventional vacuum cleaner according to the aforementioned configuration is described hereinafter. When a user turns on the vacuum cleaner to perform a cleaning work, the suction motor 10 is initiated. The Rotating force of the suction motor 10 is transferred to the suction fan 20 which is rotatably attached to a lower end of the suction motor 10. Thereafter, as the suction fan 20 rotates, a low-pressure space is formed below the suction motor 10 to draw in the air from the outside into the vacuum cleaner.

As the air is sucked in from the outside toward the low-pressure space, dust and other particles are also sucked into the vacuum cleaner along with the outside air through the suction nozzle 50.

The outside air is then directed to the dust filter 30. In the dust filter 30, while air can freely pass through the dust filter 30, dust and the particles having a size larger than that of meshes of the dust filter 30, are filtered by the dust filter 30.

Dust and other particles which did not pass through the dust filter 30, drop down to be collected in the dust collecting bucket 40, whereby one cycle of operations of the vacuum cleaner is completed.

Also, the air which passed through the dust filter 30, is exhausted to the outside after sequentially passing through the suction fan 20 and the suction motor 10. While the air passes through the suction motor 10, heat generated by the suction motor 10 is cooled.

While undergoing time serial sequences as described above, dust and other particles contained in the outside air, are filtered by the dust filter 30. If dust and the particles are collected in the dust-collecting bucket 40 built up to the point in which in flow of the air is effected and degrade an efficiency of the vacuum cleaner, a user of the vacuum cleaner should empty out the dust-collecting bucket 40.

Since the air, which is discharged to the outside after passing through the suction motor 10, flows at a high speed, the air retains a substantial amount of kinetic energy which could be utilized to improve the efficiency. However, the passage system of the conventional vacuum cleaner dose not employ any means to reuse the air having kinetic energy.

SUMMARY OF THE INVENTION

Accordingly, the present invention has been made in an effort to solve the problems occurring in the related art, and an object of the present invention is to provide a passage system of a vacuum cleaner, which enables the air to be exhausted is utilized again to provide an additional source of energy for the vacuum cleaner. And, in the case of a rechargeable vacuum cleaner wherein an output cannot be raised beyond a predetermined level due to the limitation within its own configuration, the passage system of the vacuum cleaner in accordance with the present invention allows a cleaning work to be performed in more efficient manner with the same power supply source.

In order to achieve the above object, the present invention provides a passage system of a vacuum cleaner, comprising: an ejector suction passage which is connected to one end of an outer surface of a motor case to reutilize air which has been exhausted from a suction motor; an ejector formed at the end of the ejector suction passage for accumulating air that has passed through the ejector suction passage; an ejector nozzle formed at one end of the ejector for exhausting the air at a high speed and under a low pressure; a second suction passage having one end placed at a predetermined distance from the ejector nozzle and the other end connected to a dust collecting bucket, such that the air discharged from the ejector nozzle and the air existing in an ejector chamber are simultaneously drawn in together into an ejector chamber and thereafter flows in the direction of a suction motor, an ejector chamber which is formed in the inside of the ejector nozzle, and one end of the second suction passage is connected in the ejector chamber so that an inside of the ejector chamber remains under low pressure; a second suction nozzle formed at a predetermined position in the ejector chamber to draw in the outside air at a high speed; a first suction nozzle placed at a predetermined position of the vacuum cleaner to draw the air in at a high velocity by a suction force generated by the suction motor; and a first suction passage having one end which is fastened to the first suction nozzle and the other end is connected to a predetermined part of the dust collecting bucket, in a manner such that outside air which is drawn in via the first suction nozzle, is guided toward the suction motor.

By the feature of the present invention, the passage system of a vacuum cleaner according to the present invention provides advantages in that, since energy, which is contained in air discharged through a suction motor, is utilized again, cleaning performance of the vacuum cleaner can be improved.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
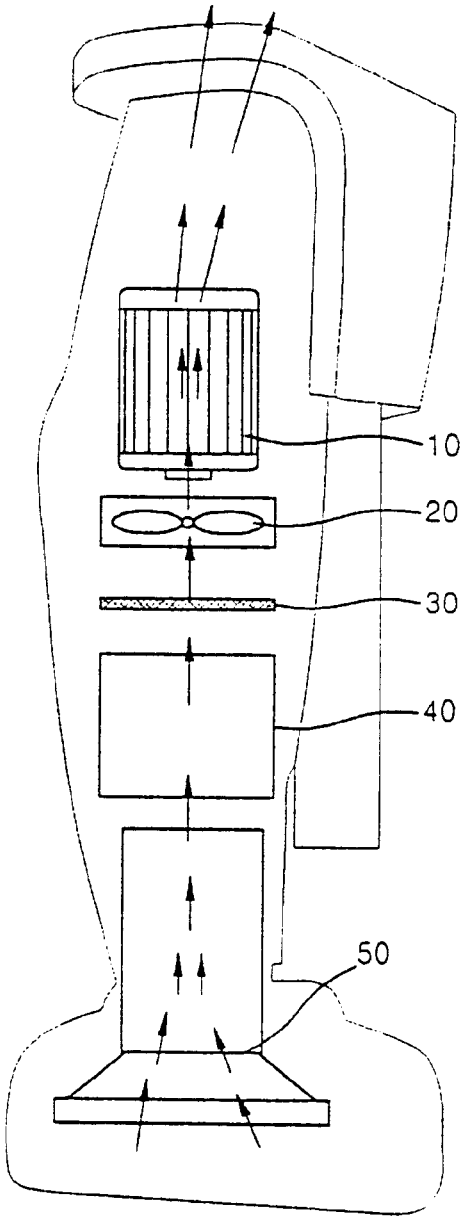
FIG. 1 BACKGROUND ART
FIG. 1 is a schematic cross-sectional view illustrating a construction of a passage system of a conventional vacuum cleaner.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
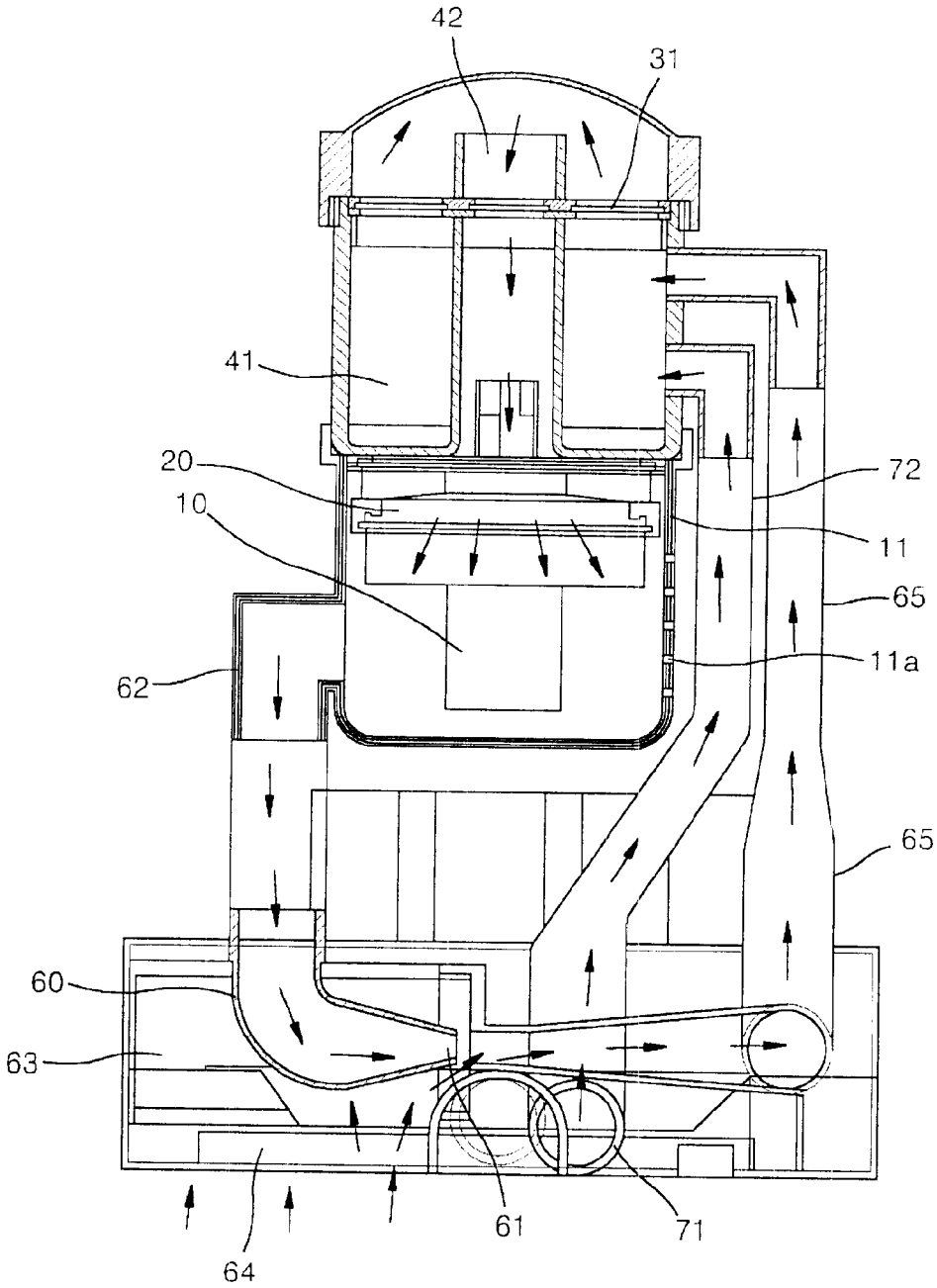
FIG. 2 is a schematic cross-sectional view illustrating a construction of a passage system of a vacuum cleaner in accordance with an embodiment of the present invention.

FIG. 2 is a schematic cross-sectional view illustrating a construction of a passage system of a vacuum cleaner in accordance with an embodiment of the present invention.

Referring to FIG. 2, in the present invention, in order to allow the outside air to be sucked into the vacuum cleaner, two suction paths are included as described below.

First, the passage system of a vacuum cleaner according to the present invention comprises a suction motor 10, a suction fan 20, a dust filter 31, a dust collecting bucket 41, a fan suction passage 42, a motor case 11, a plurality of discharging holes 11*a*, an ejector suction passage 62, an ejector 60, an ejector nozzle 61, an ejector chamber 63, a second suction nozzle 64 and a second suction passage 65.

The suction motor 10 is installed adjacent to an upper end of the vacuum cleaner to provide the suction force for draw the outside air into the vacuum cleaner. The suction fan 20 is located on an upper end of the suction motor 10 and has blades which receive the suction force from the suction motor 10 and thereby suck the outside air. The dust filter 31 is arranged above the suction fan 20 to filter out dust and other particles contained in the outside air drawn in by the suction fan 20. The dust filter 31 has a doughnut-shaped configuration. The dust-collecting bucket 41 is positioned below the dust filter 31 to collect dust and other particles filtered by the dust filter 31. The dust collecting bucket 41 has a hollow configuration. The fan suction passage 42 is placed at the center portion of the dust collecting bucket 41 in a manner such that outside air that has been through the filtering process to remove the dust and the like by the dust filter 31, flows through the fan suction passage 42 toward the suction fan 20. The fan suction passage 42 has a cylindrical shaped which is opened at an upper end thereof. The motor case 11 is formed to have a cylindrical shape to accommodate the suction motor 10. The plurality of discharging holes 11*a* are formed on a circumferential outer surface of the motor case 11 at predetermined places in a manner to exhaust the air that has been pressurized while passing through the suction fan 20 to the outside. The ejector suction passage 62 serves as an exhausting passage and is connected at one end thereof to the circumferential outer surface of the motor case 11 at a predetermined place in a manner such that the air which has been passed through the suction fan 20, can be reutilized.

The ejector 60 is formed at the other end of the ejector suction passage 62 to exhaust the air which passed through the ejector suction passage 62. The ejector nozzle 61 is placed at the lower end of the ejector 60 to further pressurize the air which has been already pressurized while passing through the suction fan 20, and then exhaust the air at a high velocity. The ejector chamber 63 is defined in a manner such that an inside of the ejector chamber 63 remains under a low pressure by the air which is ejected from the ejector nozzle 61 at a high speed. The second suction nozzle 64 is formed at a lower end of the ejector chamber 63 in a manner such that outside air can be sucked therein. The second suction passage 65 is connected at one end thereof to the duct collecting bucket 41 in a manner such that air which is ejected therein from the ejector nozzle 61 and sucked therein from the ejector chamber 63, is guided toward the suction fan 20.

A second suction path operates in the same manner as a suction path of the conventional vacuum cleaner. The second suction path according to the present invention is formed with a first suction nozzle 71 and a first suction passage 72. The first nozzle 71 directly receives the suction force generated by the suction motor 10 to draw in the outside air containing dust and other particles with intensive force. One end of the first suction passage 72 is connected to the dust-collecting bucket 41 and the other end is connected to the first suction nozzle 71, so that the outside air, which is drawn into the vacuum cleaner by the first suction nozzle 71, can pass through the first suction passage 72.

It is preferred that the first suction nozzle 71 and the second suction nozzle 64 are formed at the lowermost end of the entire vacuum cleaner structure to allow dust and the like existing on a floor to be easily drawn in along with outside air.

Hereinafter, operations of the passage system of a vacuum cleaner according to the present invention, constructed as mentioned above, will be described in detail.

When a user turns on the vacuum cleaner to perform a cleaning work, the suction motor 10 rotates, and at the same time, the suction fan 20 which is connected to the suction motor 10 also rotates.

If the suction fan 20 is rotated, the outside air is drawn in and passes through the first suction nozzle 71, the first suction passage 72, the dust collecting bucket 41, the dust filter 31 and the fan suction passage 42 in order. Upon reaching the suction fan 20 and the suction motor 10 after passing through the fan suction passage 42, air cools the suction motor 10 and at the same time is pressurized by the suction motor 10.

In the course of the suction process, dust and the like which are contained in the outside air, are filtered by the dust filter 31. As dust and other particles are piled up in the dust-collecting bucket 41, a cycle of the second outside air suction path is completed.

Hereinafter, the operation of the first outside air suction path is described in detail. The motor case 11 which accommodates the suction motor 10, is attached with the plurality of discharging holes 11*a* in which predetermined amount of air that has been pressurized while passing through the suction fan 20, is discharged to the outside, and the remaining predetermined amount of the air which has been pressurized while passing through the suction fan 20 flows into the ejector 60 through the ejector suction passage 62. A ratio between the preselected amount which is discharged to the outside through the plurality of discharging holes 11*a* and the predetermined amount which flows out through the ejector suction passage 62, can be adjusted according to the needs by adjusting the size and the number of the discharging holes 11*a*.

The air, which flows into the ejector 60, is exhausted through the ejector nozzle 61 formed at the free end of the ejector 60. Since the air is exhausted under a high pressure, it is to be readily understood that the surrounding area near the ejector nozzle 61 is maintained under a remarkably low pressure as explained in the Bernoulli's theorem, and the inside of the ejector chamber 63 which includes the discharging end of the ejector 60, also remains in a significantly low pressure.

Due to the low pressure environment which has been created in the inside the ejector chamber 63 as described above, the outside air is drawn into the vacuum cleaner through the second suction nozzle 64 which is formed at a predetermined position in the ejector chamber 63, as in the case of the first suction nozzle 71.

This function will be described hereafter in further detail using the Bernoulli's theorem.

The Bernoulli's theorem is expressed as given below:

$$H=P/\gamma+V^2/2g+Z=\text{constant},$$

where H is a total head, P is a pressure at a corresponding point, $\gamma$ is a specific weight of fluid, V is a flow velocity, g is an acceleration of gravity, and Z is a height of fluid on a reference plane. The Bernoulli's theorem applies to all incompressible fluid. According to the Bernoulli's theorem, water heads are divided into a pressure head ($P/\gamma$) due to a pressure of fluid, a velocity head ($V^2/2g$) due to a flow velocity of the fluid, and a position head (Z) due to a height of the fluid. The Bernoulli's theorem shows that the total sum of the three heads is always held equal at any point in the fluid.

Describing again operations of the passage system of a vacuum cleaner according to the present invention on the basis of the Bernoulli's theorem as deliberated above, since the air existing in the ejector 60 has a low flowing velocity, a high pressure and a constant height, the air in the surrounding area near the ejector nozzle 61, more particularly the outlet end of the ejector 60 having a high velocity at a constant height, has a low pressure when considering the Bernoulli's theorem.

As a result, a low pressure space of a sufficient level is created in between the ejector nozzle 61 and the second suction passage 65, thereby the low pressure environment is created in the inside the ejector chamber 63 that includes the low pressure space.

The second suction nozzle 64 is placed below the ejector chamber 63 to intake the outside air which then gets mixed up with the air exhausted from the ejector nozzle 61 before passing through the second suction passage 65. Consequently, in the passage system of a vacuum cleaner according to the present invention includes two suction nozzles that are formed at the outside air suction paths through which dust and the like can be sucked into the vacuum cleaner. Particularly, since the predetermined amount of air that has passed through the suction motor 10 is utilized to draw in the outside air, an efficiency of the vacuum cleaner is increased.

As described above, in the passage. system of a vacuum cleaner in accordance with the embodiment of the present invention, since the plurality of suction nozzles are formed, a cleaning capability of the vacuum cleaner for sucking the outside air has been substantially increased without using an additional source of energy, but by only modifying a passage system of the conventional vacuum cleaner.

Figure 3:
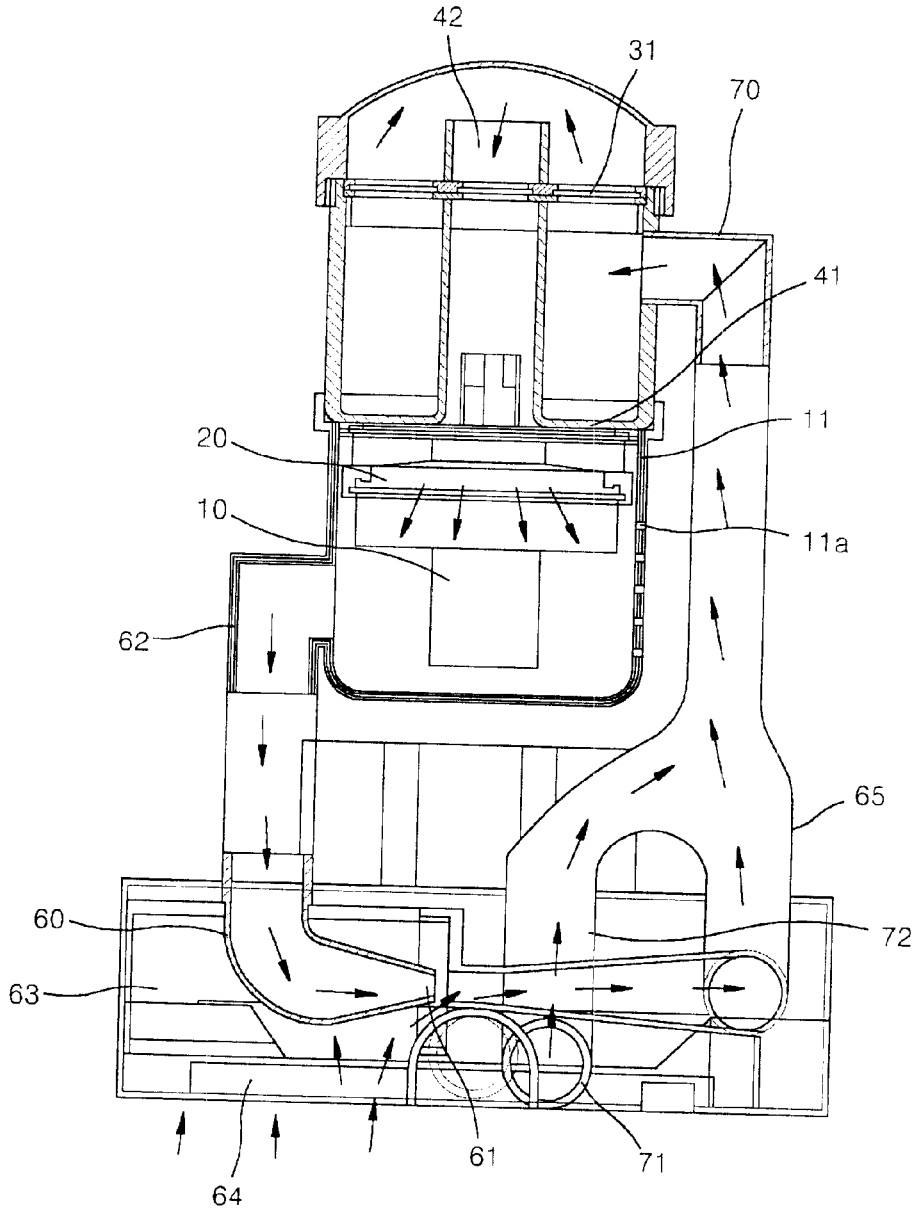
FIG. 3 is a schematic cross-sectional view illustrating a construction of a passage system of a vacuum cleaner in accordance with another embodiment of the present invention.

FIG. 3 is a schematic cross-sectional view illustrating a construction of a passage system of a vacuum cleaner in accordance with another embodiment of the present invention. In the above-described first embodiment of the present invention, although it is possible to place the first suction passage 72 and the second suction passage 65 separately and connect to the dust collecting bucket 41 at different positions, this passage construction makes not only the passage system of a vacuum cleaner more complex but also a manufacturing procedure thereof complicated. In order to resolve this problem, in the second embodiment of the present invention, an outside air passage 70 in which the first suction passage 72 and the second suction passage 65 merge is independently formed. The passage system of a vacuum cleaner in accordance with the present invention allows the outside air containing dust and other particles to flow into the dust-collecting bucket 41 via the outside air passage 70.

As a result, the passage system of a vacuum cleaner according to the present invention provides more powerful suction force for sucking the outside air through two sucking passages in the passage system, thus the cleaning process can be performed more quickly. Also, when compared with the conventional vacuum cleaner, less amount of input power is required for sucking the same amount of outside air thereby substantially saving energy. Moreover, in the case a rechargeable vacuum cleaner wherein the output of a motor cannot be raised beyond a predetermined level due to limitation within its own specification, greater cleaning capability can be accomplished when the passage system in accordance with the present invention is applied.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A passage system of a vacuum cleaner, comprising:

an ejector suction passage which is connected to one end of an outer surface of a motor case to reutilize air which has been exhausted from a suction motor;

an ejector formed at the end of the ejector suction passage for accumulating air that has passed through the ejector suction passage;

an ejector nozzle formed at one end of the ejector for exhausting the air at a high speed and under a low pressure;

a second suction passage having one end placed at a predetermined distance from the ejector nozzle and the other end connected to a dust collecting bucket, such that the air discharged from the ejector nozzle and the air existing in an ejector chamber are simultaneously drawn in together into an ejector chamber and thereafter flows in the direction of a suction motor, an ejector chamber which is formed in the inside of the ejector nozzle, and one end of the second suction passage is connected in the ejector chamber so that an inside of the ejector chamber remains under a low pressure;

a second suction nozzle formed at a predetermined position in the ejector chamber to draw in the outside air at a high speed;

a first suction nozzle placed at a predetermined position of the vacuum cleaner to draw the air in at a high velocity by a suction force generated by the suction motor; and a first suction passage having one end which is fastened to the first suction nozzle and the other end is connected to a predetermined part of the dust collecting bucket, in a manner such that outside air which is drawn in via the first suction nozzle, is guided toward the suction motor.

2. The passage system of claim 1 wherein the outer surface of the motor case is formed with a plurality of discharging holes in which a predetermined amount of air is exhausted to the outside.

3. The passage system of claim 1, wherein a suction fan for drawing the air in is placed above the suction motor.

4. The passage system of claim 1, wherein the dust collecting bucket is installed adjacent to a suction opening of the suction motor, and a fan suction passage is formed to allow the air that has been filtered to passe through in the direction of the suction motor.

5. The passage system of claim 4, wherein the fan suction passage is formed in a cylindrical shape.

6. The passage system of claim 4, wherein a dust filter is installed between a suction inlet of the fan suction passage and the first and second suction passages in a manner such that the outside air which has been filtered can flow through the fan suction passage toward the suction motor.

7. The passage system of claim 1, further comprising:

an outside air passage for merging the first suction passage and the second suction passage so that outside air containing dust and other particles becomes mixed with the air exhausted from the ejector nozzle before flowing into the dust collecting bucket.

8. The passage system of claim 1, wherein the first suction nozzle is formed at a lowermost end of the vacuum cleaner.

9. The passage system of claim 1, wherein the second suction nozzle is formed at a lowermost end of the vacuum cleaner.

* * * * *

UNITED STATES PATENT AND TRADEMARK OFFICE

CERTIFICATE OF CORRECTION

PATENT NO. : 6,484,355 B2
DATED : November 26, 2002
INVENTOR(S) : Cho et al.

It is certified that error appears in the above-identified patent and that said Letters Patent is hereby corrected as shown below:

Title page,
Item [30], Foreign Application Priority Data, replace "Oct. 4, 2001 (KR) 00-58079" with -- Oct. 4, 2000 (KR) 00-58079 --

Signed and Sealed this

Twenty-fourth Day of June, 2003

JAMES E. ROGAN
*Director of the United States Patent and Trademark Office*